US010886044B2

(12) United States Patent
Ito et al.

(10) Patent No.: US 10,886,044 B2
(45) Date of Patent: Jan. 5, 2021

(54) RARE EARTH PERMANENT MAGNET

(71) Applicant: TDK CORPORATION, Tokyo (JP)

(72) Inventors: Masashi Ito, Tokyo (JP); Eiichiro Fukuchi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/292,681

(22) Filed: Mar. 5, 2019

(65) Prior Publication Data

US 2019/0279794 A1 Sep. 12, 2019

(30) Foreign Application Priority Data

Mar. 9, 2018 (JP) ..... 2018-043650

(51) Int. Cl.

| | |
|---|---|
| ***H01F 1/058*** | (2006.01) |
| ***H01F 1/053*** | (2006.01) |
| ***H01F 1/055*** | (2006.01) |
| ***C22C 38/00*** | (2006.01) |

(52) U.S. Cl.

CPC ..... *H01F 1/058* (2013.01); *C22C 38/005* (2013.01); *H01F 1/055* (2013.01); *H01F 1/0536* (2013.01); *C22C 2202/02* (2013.01); *Y10T 428/32* (2015.01)

(58) Field of Classification Search

CPC . C22C 2202/02; C22C 38/005; H01F 1/0536; H01F 1/058; H01F 41/0266

See application file for complete search history.

(56) References Cited

U.S. PATENT DOCUMENTS

| | | | |
|---|---|---|---|
| 2008/0245442 A1 | 10/2008 | Nakamura et al. | |
| 2011/0150691 A1 | 6/2011 | Nakamura et al. | |
| 2016/0276075 A1* | 9/2016 | Ito | H01F 1/058 |

FOREIGN PATENT DOCUMENTS

| | | | |
|---|---|---|---|
| JP | 2008133496 A | * | 6/2008 |
| WO | 2006/043348 A1 | | 4/2006 |

OTHER PUBLICATIONS

Lin et al. "Magnetic Properties of (Nd, Sm)5Fe17." Journal of Physics: Condensed Matter, vol. 9, No. 43, 1997, pp. 9353-9360.*

Liu et al. "Magnetic Properties of (Nd0.9R0.1)5Fe17 with R=Sm, Gd, and Y." Journal of Applied Physics, vol. 76, No. 10, 1994, pp. 6766-6768.*

Murakami et al. "Substitutional and Interstitial Modification of Nd5Fe17." Journal of Alloys and Compounds, vol. 443, No. 1-2, 2007, pp. 1-3.*

Tetsuji Saito et al. "Synthesis and Magnetic Properties of (Pr1-xSmx)5Fe17 (x=0-1) Phase". Journal of Alloys and Compounds, 2009, vol. 488, issue 1, pp. 13-17.

Tetsuji Saito. "Synthesis and Magnetic Properties of (Nd1-xSmx)5Fe17 (x=0-1) Phase". Applied Physics Letters, 2007, vol. 91, pp. 072503-1 through 072503-3.

* cited by examiner

*Primary Examiner* — Holly C Rickman
*Assistant Examiner* — Lisa Chau
(74) *Attorney, Agent, or Firm* — Oliff PLC

(57) ABSTRACT

A rare earth permanent magnet that is high in residual magnetization and coercivity is obtained and includes R and T. A main phase of crystal grains having an $Nd_5Fe_{17}$ type crystal structure is included. In an X-ray diffraction profile drawn by performing an XRD measurement for a rare earth permanent magnet, peaks of detected intensity are present in specific ranges. In which the detected intensity of the peak with the highest detected intensity in the range of $41.60° < 2\theta(°) < 42.80°$ is set as $\alpha$, the detected intensity of the peak with the highest detected intensity in the range of $34.38° < 2\theta(°) < 34.64°$ is set as $\beta$, and the detected intensity of the peak with the highest detected intensity in the range of $38.70° < 2\theta(°) < 41.20°$ is set as $\gamma$, $0.38 < \alpha/\beta < 0.70$ and $0.45 < \gamma/\beta < 0.70$ are established. The peak with the highest detected intensity in the range of $34.38° < 2\theta(°) < 34.64°$ is a peak derived from the $Nd_5Fe_{17}$ type crystal structure.

10 Claims, No Drawings

RARE EARTH PERMANENT MAGNET

BACKGROUND OF THE INVENTION

The present invention relates to a rare earth permanent magnet.

The rare earth magnet is increased in production year by year due to high magnetic properties, and is used in various motors, various actuators and MM devices and the like.

For example, a magnet material disclosed in Patent document 1 has an intermetallic compound of $Sm_5Fe_{17}$ as a main phase, and has an extremely high coercivity of 36.8 kOe at room temperature. Accordingly, this magnet material is considered to be a desired magnet material.

However, a permanent magnet having the intermetallic compound of $Sm_5Fe_{17}$ as the main phase has a disadvantage that the residual magnetization is lower than the residual magnetization of a permanent magnet having an intermetallic compound of $Nd_2Fe_{14}B$ as the main phase.

In Non patent document 1 and Non patent document 2, an experiment in which a part of Sm of $Sm_5Fe_{17}$ is substituted by Pr or Nd is conducted. $Nd^{3+}$ or $Pr^{3+}$ has a higher magnetic moment compared with $Sm^{3+}$, and thus the residual magnetization is expected to be improved by substitution from Sm to Pr or Nd. However, actually, the content ratio of phases other than the main phase becomes too large when Sm is substituted to Nd or Pr, and the coercivity is reduced greatly.

Patent document 1: WO 2006/043348 A1

Non patent document 1: T. Saito, T. Furutani, Journal of Alloys and Compounds, Volume 488, Issue 1, 13-17, (2009), Synthesis and magnetic properties of $(Pr_{1-x}Sm_x)_5Fe_{17}$ (x=0-1) phase Non patent document 2: T. Saito, Applied Physics Letter, Volume 91, 072053, (2007), Synthesis and magnetic properties of $(Nd_{1-x}Sm_x)_5Fe_{17}$(x=0-1) phase

BRIEF SUMMARY OF INVENTION

The present invention is accomplished in view of this situation. An object of the present invention is to obtain a rare earth permanent magnet having a compound of $Nd_5Fe_{17}$ type crystal structure as a main phase and being high in residual magnetization and coercivity.

The present invention is a rare earth permanent magnet including R and T;

wherein R is two or more rare earth elements and includes Sm and one of Pr and Nd essentially, and T is Fe only or Fe and Co;

a content ratio of R with respect to the entire rare earth permanent magnet is 20.0 at % or more and 37.1 at % or less, and a content ratio of T is 47.9 at % or more and 80.0 at % or less;

a content ratio of Sm with respect to the entire R is 50.0 at % or more and 99.0 at % or less, and a total content ratio of Pr and Nd is 1.0 at % or more and 50.0 at % or less;

the rare earth permanent magnet includes a main phase consisting of crystal grains having an $Nd_5Fe_{17}$ type crystal structure;

at least one peak of a detected intensity is present in each of ranges of $34.38°<2\theta(°)<34.64°$, $38.70°<2\theta(°)<41.20°$ and $41.60°<2\theta(°)<42.80°$ in an X-ray diffraction profile, which is drawn by using a Cu tube to perform an XRD measurement for the rare earth permanent magnet and taking a diffraction angle $2\theta(°)$ as a horizontal axis and the detected intensity as a vertical axis;

$0.38<\alpha/\beta<0.70$ and $0.45<\gamma/(3<0.70$ are established in which the detected intensity of the peak with the highest detected intensity in the range of $41.60°<2\theta(°)<42.80°$ is set as $\alpha$, the detected intensity of the peak with the highest detected intensity in the range of $34.38°<2\theta(°)<34.64°$ is set as $\beta$, and the detected intensity of the peak with the highest detected intensity in the range of $38.70°<2\theta(°)<41.20°$ is set as $\gamma$; and the peak with the highest detected intensity in the range of $34.38°<2\theta(°)<34.64°$ is a peak derived from the $Nd_5Fe_r$ type crystal structure.

Since the rare earth permanent magnet of the present invention has the above constitution, the content ratios of the main phase and a sub phase of the rare earth permanent magnet of the present invention are controlled suitably, and the residual magnetization and the coercivity of the rare earth permanent magnet of the present invention are increased. That is, the magnetic properties of the rare earth permanent magnet of the present invention are improved by having the above constitution.

The content ratio of R with respect to the entire rare earth permanent magnet may be 20.3 at % or more and 37.0 at % or less.

The content ratio of R with respect to the entire rare earth permanent magnet may be 22.2 at % or more and 24.4 at % or less.

The total content ratio of Pr and Nd with respect to the entire R may be 10.0 at % or more and 35.0 at % or less.

The content ratio of T with respect to the entire rare earth permanent magnet may be 63.0 at % or more and 79.7 at % or less.

The content ratio of C with respect to the entire rare earth permanent magnet further including C may be more than 0 at % and 15.0 at % or less.

The content ratio of C may be 0.1 at % or more and 4.9 at % or less.

The rare earth permanent magnet of the present invention may be a rare earth sintered magnet.

DETAILED DESCRIPTION OF INVENTION

Embodiments of the present invention are described in detail. The present invention is not limited by content described in the following embodiments. In addition, constituents described below include the constituents that can be easily assumed by a person skilled in the art and the constituents that are substantially the same. Furthermore, the constituents described below can be combined appropriately.

A rare earth permanent magnet of the embodiment has crystal grains having an $Nd_5Fe_{17}$ type crystal structure (a space group of $P6_3/mcm$) as a main phase. In the following description, a phase including the crystal grains having the $Nd_5Fe_r$ type crystal structure is described as an $R_5T_{17}$ crystal phase. Besides, in the embodiment, a total volume of main phases is 70 vol % or more with respect to the entire rare earth permanent magnet.

The rare earth permanent magnet of the embodiment may include a crystal phase other than the above $R_5T_{17}$ crystal phase as a sub phase. For example, an R-T crystal phase other than the $R_5T_{17}$ crystal phase may be included. The R-T crystal phase includes, for example, an $RT_2$ crystal phase, an $RT_3$ crystal phase, an $R_2T_7$ crystal phase, an $RT_5$ crystal phase, an $RT_7$ crystal phase, an $R_2T_{17}$ crystal phase, and an $Kr_{12}$ crystal phase and the like.

An X-ray diffraction method (XRD) using the Cu tube can be used to confirm which type of crystal structure is included in the rare earth permanent magnet of the embodiment. Then, for the rare earth permanent magnet of the embodiment, in an X-ray diffraction profile which is drawn by taking a diffraction angle 20(°) as a horizontal axis and a detected intensity as a vertical axis, at least one peak of a detected intensity is present in each of ranges of $34.38° < 2\theta(°) < 34.64°$, $38.70° < 2\theta(°) < 41.20°$ and $41.60° < 2\theta(°) < 42.80°$.

Furthermore, in which the detected intensity of the peak with the highest detected intensity in the range of $41.60° < 2\theta(°) < 42.80°$ is set as $\alpha$, the detected intensity of the peak with the highest detected intensity in the range of $34.38° < 2\theta(°) < 34.64°$ is set as $\beta$, and the detected intensity of the peak with the highest detected intensity in the range of $38.70° < 2\theta(°) < 41.20°$ is set as $\gamma$, $0.38 < \alpha/\beta < 0.70$ and $0.45 < \gamma/(3 < 0.70$ are established.

Besides, the rare earth permanent magnet of the embodiment has a constitution in that the peak with the highest detected intensity in the range of $34.38° < 2\theta(°) < 34.64°$ is a peak derived from the $Nd_5Fe_{17}$ type crystal structure.

The angle of diffraction peak and the lattice constant of the $Nd_5Fe_{17}$ type crystal structure can be controlled by the composition of the rare earth permanent magnet, the manufacturing method of the rare earth permanent magnet, and the like of the rare earth permanent magnet. In the embodiment, a proper dose of Nd or Pr is substituted to Sm sites of $Sm_5Fe_{17}$, and thereby for the rare earth permanent magnet which has the crystal grains having the $Nd_5Fe_{17}$ type crystal structure as the main phase, in an X-ray diffraction profile, the rare earth permanent magnet which has the crystal grains having the $Nd_5Fe_{17}$ type crystal structure as the main phase has the peak with the highest detected intensity in the range of $34.38° < 2\theta(°) < 34.64°$, and thus the magnetic properties of the rare earth permanent magnet can be improved.

In addition, in the embodiment, the peak with the highest detected intensity in the range of $41.60° < 2\theta(°) < 42.80°$ is a peak mainly derived from an $R_2T_{17}$ type crystal structure. Besides, the peak with the highest detected intensity in the range of $38.70° < 2\theta(°) < 41.20°$ is a peak mainly derived from an $R_2T_2$ type crystal structure and/or an $RT_3$ type crystal structure.

Besides, in the X-ray diffraction method of the embodiment, a tube current, a tube voltage, a measurement step width and a sweep rate are not limited and can be set appropriately, and in order to correctly measure the diffraction angle of the peak, the measurement step width can be set to, for example, 0.001°-0.015°, and the sweep rate can be set to, for example, 0.01°/min-2.00°/min.

Conventionally, the crystal grains having the $Nd_5Fe_{17}$ type crystal structure is considered to have a relatively high magnetocrystalline anisotropy constant, and therefore, it is considered that the magnetic properties are improved when the content ratio of the main phase is higher. Conversely, the sub phase is considered to have a relatively low magnetocrystalline anisotropy constant. Therefore, it is considered that higher magnetic properties can be obtained when the content ratio of the sub phase is lower.

In contrast, the rare earth permanent magnet of the embodiment has a constitution of $0.38 < \alpha/\beta < 0.70$ and $0.45 < \gamma/\beta < 0.70$. That is, the content ratio of the main phase and the content ratio of the sub phase are controlled suitably and thereby $0.38 < \alpha/\beta < 0.70$ and $0.45 < \gamma/\beta < 0.70$ are established. The inventors found that it is not as simple as that a higher content ratio of the main phase is preferable, and found that it is further preferable to include the sub phase such that $\alpha/\beta$ and $\gamma/\beta$ are in the above range. The method for controlling the content ratio of the main phase and the content ratio of the sub phase is not limited. For example, by changing the composition of the rare earth permanent magnet and heat treatment conditions during a heat treatment described later and the like, the content ratio of the main phase and the content ratio of the sub phase can be controlled. When $\alpha/\beta$ and/or $\gamma/\beta$ are/is larger than the above range, there is a tendency that the ratio of the sub phase which is a low-coercivity component is increased and the coercivity of the rare earth permanent magnet is reduced. When $\alpha/\beta$ and/or $\gamma/\beta$ are/is smaller than the above range, the coercivity tends to decrease, which is considered to be because the pinning sites for suppressing the magnetization reversal are decreased inside the rare earth permanent magnet.

Besides, "$0.38 < \alpha/\beta < 0.70$" does not mean that "(the content ratio of $R_2T_{17}$ crystal phase)/(the content ratio of $R_5T_{17}$ crystal phase) is more than 0.38 and less than 0.70". The reason is that the detected intensity is different depending on the type of the crystal structure, and the peaks derived from multiple types of crystal structures may duplicate and become one peak. The same applies to $\gamma/\beta$.

The rare earth permanent magnet of the embodiment includes R and T. R is two or more rare earth elements and includes Sm and one of Pr and Nd essentially. For the rare earth permanent magnet of the embodiment, a high ratio of Sm in R is preferably, and the ratio of Sm with respect to the entire R in the entire rare earth permanent magnet is 50 at % or more.

In addition, Pr or Nd is necessary for R. Since effective magnetic moments of $Pr^{3+}$ and $Nd^{3+}$ are larger than the effective magnetic moment of $Sm^{3+}$, there is a tendency that the residual magnetization is improved when Pr or Nd is contained. Furthermore, a proper dose of Pr or Nd can suppress the generation of sub phase which is a low-coercivity component. However, the magnetocrystalline anisotropy constant of the $R_5T_{17}$ crystal phase is decreased when the total content ratio of Pr and Nd in R is too large, and the sub phase which is a low-coercivity component is generated easily and a coercivity is reduced easily.

Accordingly, the content ratio of Sm with respect to the entire R is 50.0 at % or more and 99.0 at % or less, and the total content ratio of Pr and Nd is 1.0 at % or more and 50.0 at % or less. A preferable range of the total content ratio of Pr and Nd with respect to the entire R is 10.0 at % or more and 35.0 at % or less, and the balance of R is preferably Sm. In addition, in a range that a significant effect is not given on the magnetic property of the rare earth permanent magnet of the embodiment, the rare earth elements other than Sm, Pr and Nd may be included as R. The content of the rare earth elements other than Sm, Pr and Nd is, for example, 5.0 at % or less.

In addition, the diffraction angle of the peak derived from the $Nd_5Fe_r$ type crystal structure varies with the total content ratio of Pr and Nd. In the embodiment, there is a tendency that the diffraction angle of the peak derived from the $Nd_5Fe_1$, type crystal structure becomes smaller when the total content ratio of Pr and Nd is larger.

The content ratio of R in the rare earth permanent magnet of the embodiment is 20.0 at % or more and 37.1 at % or less. The content ratio of R may also be 20.3 at % or more and 37.0 at % or less. The content ratio of R may also be 22.2 at % or more and 24.4 at % or less. When the content ratio of R is too small, $\alpha/\beta$ is too large and the coercivity of the rare earth permanent magnet is reduced. When the content ratio of R is too large, $\gamma/\beta$ is too large and the residual magnetization of the rare earth permanent magnet is reduced.

The content ratio of T in the rare earth permanent magnet of the embodiment is 47.9 at % or more and 80.0 at % or less. The content ratio of T may also be 63.0 at % or more 79.7 at % or less. T is Fe only or Fe and Co. In addition, the content ratio of Co with respect to the entire T is not limited and may be 0 at % or more and 20.0 at % or less. The smaller the content ratio of Co is, the higher the coercivity of the rare earth permanent magnet tends to be. In addition, the larger the content ratio of Co is, the higher the residual magnetization of the rare earth permanent magnet tends to be.

The rare earth permanent magnet of the embodiment may include C, and there is a tendency that the coercivity of the rare earth permanent magnet is improved by including C. Although the reason of the improvement of the coercivity is unknown, the inventors consider that the rare earth permanent magnet includes C and thereby an R-rich phase such as an R-T-M-C phase or an R-T-C phase is easily formed in a grain boundary phase between the crystal grains. Besides, the inventors consider that because the R-rich phase such as the R-T-M-C phase or the R-T-C phase is a non-magnetic phase and the effect of magnetic separation is high, the coercivity of the rare earth permanent magnet is improved. When the rare earth permanent magnet of the embodiment includes C, the content ratio of C is preferably more than 0 at % and 15.0 at % or less. The content ratio of C may also be 0.1 at % or more and 15.0 at % or less. The content ratio of C may also be 0.1 at % or more and 4.9 at % or less.

Preferably, the rare earth permanent magnet of the embodiment does not substantially include elements other than the above R, T and C. Not substantially including the elements other than R, T and C refers to a case that the content ratio of the elements other than R, T and C with respect to the entire rare earth permanent magnet is 3.0 at % or less. Types of the other elements include, for example, Zr, Ti, Bi, Sn, Ga, Nb, Ta, Si, V, Ag, Ge, Cu, Zn and the like. In addition, the rare earth permanent magnet of the embodiment may contain other intrusion elements, and the intrusion elements can be one or more elements selected from the group consisted of N, H, Be and P.

In addition, an ICP mass spectrometry is used in an analysis of the composition ratio of the entire rare earth permanent magnet of the embodiment. In addition, combustion in oxygen stream-infrared absorption method may be used in combination if necessary.

In the following, suitable examples of a manufacturing method of the rare earth permanent magnet of the embodiment are described.

The manufacturing method of the rare earth permanent magnet includes, a book mold method, a strip casting method, an ultra-rapid solidification method, a vapor deposition method, an HDDR method and the like, and an example of a manufacturing method using the ultra-rapid solidification method is described.

Specifically, the ultra-rapid solidification method includes single-roller method, a double-roller method, centrifugal quenching method, gas atomizing method and etc., and the single-roller method is preferably used. In the single-roller method, molten alloy is ejected from nozzle and collides with the circumferential surface of the quenching roller. And thereby the molten alloy is cooled rapidly, and a ribbon-shaped or flake-shaped rapidly-cooled alloy is obtained. Compared with other ultra-rapid solidification methods, the single-roller method has a higher productivity and is excellent in reproducibility of the rapid-cooling conditions.

As raw materials, firstly, an alloy ingot having a desired composition ratio is prepared. A raw material alloy can be produced by melting a raw material metal containing R, T and the like in an inert gas, preferably an Ar atmosphere, by a melting method such as an arc melting or other well-known melting methods.

From the alloy ingot produced by the above method, a melt spun ribbon is produced by the ultra-rapid solidification method. As the ultra-rapid solidification method, for example, a melt-spinning method can be used, in which the above alloy ingot is broken into small pieces by a stamp mill and the like to obtain the small pieces, the obtained small pieces are melted with a high frequency in the Ar atmosphere to obtain a molten metal, and the obtained molten metal is discharged onto the quenching roller which is rotating rapidly, and is rapidly cooled and solidified. The molten metal rapidly cooled by the quenching roller becomes a melt spun ribbon which is rapidly cooled and solidified into a ribbon shape.

Besides, the method of breaking an alloy ingot into small pieces is not limited to the stamp mill. The atmosphere during the high-frequency melting is not limited to the Ar atmosphere. A rotation rate of the quenching roller is not limited. For example, the rotation rate may be 10 m/s or more and 100 m/s or less. The material of the quenching roller is not limited, for example, a copper roller may be used as the quenching roller.

Next, the $R_5T_{17}$ crystal phase is generated by heating the obtained melt spun ribbon. Conventionally, it is considered that increasing the content ratio of the $R_5T_{17}$ crystal phase and decreasing the content ratio of the sub phase are preferable in the improvement of the magnetic properties. Conventionally, it is considered that the $R_5T_{17}$ crystal phase is unstable to heat, and that the $R_5T_{17}$ crystal phase is not stably generated if the heat treatment is not performed at a suitable heating rate. Furthermore, when a retention time of heating is long, the $R_5T_{17}$ crystal phase is decomposed by heat and the sub phase is generated, and thus this situation is considered unpreferable. From the above, it is considered that the suitable heating rate is necessary, and the retention time of heating is preferably as short as possible in a range that the $R_5T_{17}$ crystal phase is sufficiently generated.

In contrast, the inventors found that the $R_5T_{17}$ crystal phase is stabilized even if the retention time of heating is long when a part of Sm is substituted to Nd and/or Pr. That is, contrary to the above common general technical knowledge, such a point is found that the content ratio of the $R_5T_{17}$ crystal phase is increased when the retention time of heating is longer. In the embodiment, for example, the heating rate may be set to 0.01° C./s or more and 30° C./s or less. In addition, the retention time of heating may be set to 12 hours or more and 168 hours or less. The $R_5T_{17}$ phase is stabilized by the substitution of Pr and/or Nd, and thus a generation amount of the sub phase does not increase too much even if the retention time of heating is long.

In the above, an example of the manufacturing method of the rare earth permanent magnet of the embodiment is described, but the manufacturing method of the rare earth permanent magnet is not limited.

Next, an example of a method for manufacturing the rare earth permanent magnet which is a rare earth sintered magnet is described.

An alloy ingot which is similar to the alloy ingot described in the above manufacturing method of the rare earth permanent magnet is prepared. Next, the $R_5T_{17}$ crystal phase is generated by heating the alloy ingot. Heating conditions in this case are the same as the heating conditions in the case of heating the melt spun ribbon described in the above manufacturing method of the rare earth permanent magnet.

The alloy ingot is pulverized after the alloy ingot is heated and crystallized, and fine powder having a grain size of about several micrometers is obtained. The pulverization may be conducted in two stages of coarse pulverization and fine pulverization, or may be conducted in only one stage of fine pulverization.

Next, the obtained fine powder is molded into a specified shape to obtain a green compact. Pressure during the molding is not limited. For example, the pressure is 30 MPa or more and 1 GPa or less. In addition, when single-domain grains are generated by the crystallization, the single-domain grains may be molded into an anisotropic magnet by molding in a magnetic field.

Next, the rare earth sintered magnet can be obtained by sintering the obtained formed body. The atmosphere during the sintering is not limited. For example, the atmosphere can be set to the Ar atmosphere. A sintering temperature is not limited. For example, the sintering temperature can be set to 500° C. or more and 850° C. or less. A sintering time is not limited. For example, the sintering time can be set to 10 minutes or more and 10 hours or less. A cooling rate after the sintering is not limited. For example, the cooling rate can be set to 0.01° C./s or more and 30° C./s or less.

In the above, an example of the manufacturing method of the rare earth sintered magnet of the embodiment is described, but the manufacturing method of the rare earth sintered magnet is not limited.

Example

In the following, the present invention is specifically explained based on examples and comparative examples, but the present invention is not limited to the following examples.

Experimental Example 1

Firstly, raw materials consisting of a simple substance or an alloy of Sm, Pr, Nd, Fe and/or C were prepared. The raw materials were blended so that the composition of the obtained rare earth permanent magnet (melt spun ribbon) was the composition of the following Table 1, and an alloy ingot was produced by performing arc melting in the Ar atmosphere. Next, the stamp mill was used to break the alloy ingot into small pieces to obtain the small pieces. Next, the small pieces were melted with a high frequency in the Ar atmosphere of 50 kPa to obtain a molten metal. Next, a melt spun ribbon was obtained from the molten metal by the single-roller method. Specifically, the molten metal was discharged to a quenching roller (a copper roller) which rotates at a peripheral rate of 40 m/s to obtain the melt spun ribbon.

Next, the obtained melt spun ribbon was cooled after being heated at a temperature increase rate and for a retention time shown in the following Table 1.

A pulse excitation type J-H curve tracer having a maximum applied magnetic field of ±100 kOe was used to measure the magnetic properties of the obtained melt spun ribbon. In this example, the case in which a residual magnetization $\sigma_r$ was 40.1 emu/g or more was considered as good. In addition, the case in which a coercivity H, was 32.0 kOe or more was considered as good. In addition, ICP mass spectrometry, in combination with the combustion in oxygen stream-infrared absorption method if necessary, was used to confirm that the composition of the obtained melt spun ribbon was the composition shown in Table 1. Specifically, the combustion in oxygen stream-infrared absorption method was used to measure C content.

Then, the obtained melt spun ribbon was pulverized into powder in a mortar and the XRD measurement is performed. Specifically, the powder obtained by being pulverized in the mortar was filled into a slit of a glass substrate having a height of 18 mm, a width of 20 mm and a depth of 0.5 mm and disposed on a sample stage. After that, the XRD measurement using the Cu tube was performed and the X-ray diffraction profile was drawn. An RINT2000 made by RIGAKU was used as a measurement device. In addition, a tube current was 300 mA, a tube voltage was 50 kV, a measurement step width was 0.01°, and a sweep rate was 1°/min. From the X-ray diffraction profile which was drawn by taking the diffraction angle 2θ(°) as the horizontal axis and the detected intensity as the vertical axis, it was confirmed whether the peak of detected intensity was present in each of the ranges of $34.38° < 2\theta(°) < 34.64°$, $38.70° < 2\theta(°) < 41.20°$ and $41.60° < 2\theta(°) < 42.80°$. Then, α/β and γ/β were calculated. Furthermore, it was confirmed whether the diffraction angle 2θ of the peak derived from the $Nd_5Fe_{17}$ type crystal structure was in the range of $34.38° < 2\theta(°) < 34.64°$. The result is shown in Table 1. Besides, in a comparative example in which the peak of detected intensity was not present in the range of $34.38° < 2\theta(°) < 34.64°$, for convenience, the strongest detected intensity of the peak derived from the $Nd_5Fe_r$ type crystal structure was set as β even when the peak was outside the range of $34.38° < 2\theta(°) < 34.64°$.

TABLE 1

| | | Composition of rare earth permanent magnet | | | | | | Heat treatment condition | |
|---|---|---|---|---|---|---|---|---|---|
| Sample number | Example/ Comparative example | Sm (at %) | Pr (at %) | Nd (at %) | Fe (at %) | C (at %) | (Pr + Nd)/R (Atomic ratio) | Temperature increase rate ° C./s | Retention time h |
| Sample 1 | Comparative example | 24.1 | 0.0 | 0.0 | 75.9 | 0.0 | 0.00 | 0.5 | 1 |
| Sample 2 | Comparative example | 24.1 | 0.0 | 0.0 | 75.9 | 0.0 | 0.00 | 5 | 48 |
| Sample 3 | Example | 23.9 | 0.4 | 0.0 | 75.7 | 0.0 | 0.02 | 5 | 48 |
| Sample 4 | Example | 21.8 | 2.4 | 0.0 | 75.8 | 0.0 | 0.10 | 5 | 48 |
| Sample 5 | Comparative example | 21.8 | 2.4 | 0.0 | 75.8 | 0.0 | 0.10 | 5 | 6 |
| Sample 6 | Example | 18.7 | 5.3 | 0.0 | 76.0 | 0.0 | 0.22 | 5 | 48 |
| Sample 7 | Example | 18.7 | 5.3 | 0.0 | 76.0 | 0.0 | 0.22 | 5 | 12 |
| Sample 8 | Comparative example | 18.7 | 5.3 | 0.0 | 76.0 | 0.0 | 0.22 | 5 | 6 |

TABLE 1-continued

| | | | | | | | | | |
|---|---|---|---|---|---|---|---|---|---|
| Sample 9 | Comparative example | 18.7 | 5.3 | 0.0 | 76.0 | 0.0 | 0.22 | 0.5 | 1 |
| Sample I | Example | 18.7 | 5.3 | 0.0 | 76.0 | 0.0 | 0.22 | 0.5 | 48 |
| Sample II | Comparative example | 18.7 | 5.3 | 0.0 | 76.0 | 0.0 | 0.22 | 5 | 384 |
| Sample 10 | Example | 16.5 | 7.8 | 0.0 | 75.7 | 0.0 | 0.32 | 5 | 48 |
| Sample 11 | Comparative example | 16.5 | 7.8 | 0.0 | 75.7 | 0.0 | 0.32 | 5 | 6 |
| Sample 12 | Example | 14.0 | 9.5 | 0.0 | 76.5 | 0.0 | 0.40 | 5 | 48 |
| Sample 13 | Example | 12.3 | 12.0 | 0.0 | 75.7 | 0.0 | 0.49 | 5 | 48 |
| Sample 14 | Comparative example | 11.9 | 12.3 | 0.0 | 75.8 | 0.0 | 0.51 | 5 | 48 |
| Sample 15 | Example | 23.5 | 0.0 | 0.8 | 75.7 | 0.0 | 0.03 | 5 | 48 |
| Sample 16 | Example | 18.8 | 0.0 | 5.3 | 75.9 | 0.0 | 0.22 | 5 | 48 |
| Sample 17 | Example | 16.7 | 0.0 | 7.7 | 75.6 | 0.0 | 0.32 | 5 | 48 |
| Sample 18 | Comparative example | 16.7 | 0.0 | 7.7 | 75.6 | 0.0 | 0.32 | 5 | 6 |
| Sample 19 | Example | 13.9 | 0.0 | 9.6 | 76.5 | 0.0 | 0.41 | 5 | 48 |
| Sample 20 | Example | 12.2 | 0.0 | 11.9 | 75.9 | 0.0 | 0.49 | 5 | 48 |
| Sample 21 | Comparative example | 11.8 | 0.0 | 12.5 | 75.7 | 0.0 | 0.51 | 5 | 48 |
| Sample 22 | Comparative example | 15.6 | 4.3 | 0.0 | 80.1 | 0.0 | 0.22 | 5 | 48 |
| Sample 23 | Example | 15.9 | 4.4 | 0.0 | 79.7 | 0.0 | 0.22 | 5 | 48 |
| Sample 24 | Example | 29.0 | 8.0 | 0.0 | 63.0 | 0.0 | 0.22 | 5 | 48 |
| Sample 25 | Comparative example | 29.4 | 8.2 | 0.0 | 62.4 | 0.0 | 0.22 | 5 | 48 |
| Sample 26 | Example | 18.6 | 5.2 | 0.0 | 76.1 | 0.1 | 0.22 | 5 | 48 |
| Sample 27 | Example | 17.5 | 4.7 | 0.0 | 72.9 | 4.9 | 0.21 | 5 | 48 |
| Sample 28 | Example | 15.4 | 5.0 | 0.0 | 64.8 | 14.8 | 0.25 | 5 | 48 |
| Sample 29 | Example | 15.1 | 4.9 | 0.0 | 65.0 | 15.0 | 0.25 | 5 | 48 |

| Sample number | α/β Peak intensity ratio | γ/β Peak intensity ratio | Angle(2θ) of highest peak derived from $Nd_5Fe_{17}$ type crystal structure (°) | $H_c$ (kOe) | $\sigma_r$ (emu/g) |
|---|---|---|---|---|---|
| Sample 1 | 0.45 | 0.50 | 34.64 | 44.2 | 40.0 |
| Sample 2 | 0.72 | 0.71 | 34.64 | 28.4 | 39.1 |
| Sample 3 | 0.49 | 0.51 | 34.63 | 43.1 | 40.1 |
| Sample 4 | 0.50 | 0.52 | 34.59 | 42.9 | 42.7 |
| Sample 5 | 0.74 | 0.69 | 34.59 | 31.3 | 43.2 |
| Sample 6 | 0.50 | 0.52 | 34.54 | 41.6 | 43.7 |
| Sample 7 | 0.68 | 0.63 | 34.54 | 33.5 | 43.9 |
| Sample 8 | 0.71 | 0.65 | 34.54 | 31.5 | 43.9 |
| Sample 9 | 0.85 | 0.61 | 34.54 | 24.6 | 42.5 |
| Sample I | 0.49 | 0.53 | 34.54 | 40.1 | 43.0 |
| Sample II | 0.37 | 0.43 | 35.53 | 31.5 | 44.5 |
| Sample 10 | 0.47 | 0.52 | 34.49 | 37.6 | 44.5 |
| Sample 11 | 0.79 | 0.58 | 34.49 | 30.1 | 46.2 |
| Sample 12 | 0.51 | 0.54 | 34.45 | 34.2 | 47.2 |
| Sample 13 | 0.52 | 0.69 | 34.40 | 33.0 | 49.6 |
| Sample 14 | 0.81 | 0.69 | 34.38 | 31.4 | 50.2 |
| Sample 15 | 0.49 | 0.59 | 34.63 | 43.2 | 40.2 |
| Sample 16 | 0.49 | 0.61 | 34.56 | 40.2 | 44.1 |
| Sample 17 | 0.48 | 0.62 | 34.52 | 36.9 | 45.0 |
| Sample 18 | 0.68 | 0.74 | 34.52 | 27.5 | 46.5 |
| Sample 19 | 0.45 | 0.64 | 34.51 | 33.2 | 47.5 |
| Sample 20 | 0.50 | 0.69 | 34.49 | 32.0 | 49.7 |
| Sample 21 | 0.69 | 0.72 | 34.47 | 28.4 | 50.4 |
| Sample 22 | 0.79 | 0.51 | 34.54 | 31.6 | 48.5 |
| Sample 23 | 0.68 | 0.50 | 34.54 | 32.3 | 47.9 |
| Sample 24 | 0.52 | 0.69 | 34.54 | 41.6 | 40.5 |
| Sample 25 | 0.52 | 0.71 | 34.54 | 40.2 | 39.4 |
| Sample 26 | 0.49 | 0.46 | 34.54 | 41.7 | 43.6 |
| Sample 27 | 0.48 | 0.48 | 34.51 | 44.5 | 42.8 |
| Sample 28 | 0.39 | 0.46 | 34.48 | 34.2 | 40.3 |
| Sample 29 | 0.39 | 0.46 | 34.53 | 32.0 | 40.1 |

According to Table 1, excellent magnetic properties were obtained in each example in which α/β and γ/β were in the scope of the present invention and the peak of the detected intensity present in the range of 34.38°<2θ(°)<34.64° was the peak of the detected intensity derived from the $Nd_5Fe_{17}$ type crystal structure. Besides, it was also confirmed in each example that at least one peak of the detected intensity was present in each of the ranges of 34.38°<2θ(°)<34.64°, 38.70°<2θ(°)<41.20° and 41.60°<2θ(°)<42.80°.

In contrast, in sample 1 and sample 2 in which R was Sm only and the diffraction angle 2θ in the peak of the detected intensity derived from the $Nd_5Fe_1$, type crystal structure was outside the range of 34.38°<2θ(°)<34.64°, the residual magnetization $\sigma_r$ was reduced.

Furthermore, α/β and γ/β of sample 2 in which the temperature increase rate was 5° C./s and the retention time was 48 hours were too high. Besides, compared with sample 1, in which the temperature increase rate was 0.5° C./s and the retention time was 1 hour and α/β and γ/β are in the scope of the present invention, the coercivity $H_c$ was particularly low.

In addition, the coercivity $H_c$ was reduced in each comparative example, in which α/β was too high and the detected intensity of the peak which was considered to be mainly derived from the $R_2T_{17}$ type crystal structure was relatively too high. The coercivity $H_c$ or the residual magnetization $\sigma_r$ was reduced in each comparative example, in which γ/β was too high and the detected intensity of the peak which was considered to be mainly derived from the $RT_2$ type crystal structure and/or $RT_3$ type crystal structure was relatively too high.

The retention time of sample I was longer than the retention time of sample 9 (comparative example). The sub phase which was a low-coercivity component was decreased, and the ratio of the main phase was increased. As a result, α/β and γ/β fall in a suitable range and the coercivity $H_c$ was increased.

The retention time of sample II was even longer than the retention time of sample 6 (example). As a result, the ratio of the sub phase was further decreased, α/β and γ/β were smaller than the suitable range, and the coercivity $H_c$ was reduced. The reason of the reduction of the coercivity $H_c$ is considered to be that the retention time was stretched and thereby coarse grains increased so that the magnetization reversal occurred easily, and the ratio of the sub phase was too small so that the pinning sites for suppressing the magnetization reversal decreased.

Experimental Example 2

In experimental example 2, the rare earth sintered magnet is produced and evaluated.

The raw materials were blended so that the composition of the obtained rare earth permanent magnet (melt spun ribbon) was the composition of the following Table 2, and the alloy ingot was produced by performing the arc melting in the Ar atmosphere. Next, the alloy ingot was subjected to a heat treatment under heat treatment conditions shown in the following Table 2.

Next, the ingot on which the heat treatment was performed was subjected to coarse pulverization and fine pulverization to obtain fine powder having an average grain size of about 5 μm. The coarse pulverization was performed by a stamp mill, and the fine pulverization was performed by a jet mill. Next, after the fine powder was molded into a rectangular shape of 10 mm x15 mmx 12 mm in a magnetic field, sintering and crystallization were performed at a sintering retention temperature of 800° C., a sintering retention time of 1 hour and a cooling rate after sintering of 5° C./min to obtain the rare earth sintered magnet.

Next, the magnetic properties of the obtained rare earth sintered magnet were measured. The pulse excitation type J-H curve tracer having a maximum applied magnetic field of ±100 kOe was used to measure the magnetic properties. In addition, it was confirmed by the ICP mass spectrometry that the composition of the obtained rare earth sintered magnet was the composition shown in Table 2.

Then, the obtained rare earth sintered magnet was pulverized into powder in the mortar and the XRD measurement was performed. Specifically, the powder obtained by being pulverized in the mortar was filled into the slit of the glass substrate having a height of 18 mm, a width of 20 mm and a depth of 0.5 mm and disposed on the sample stage. After that, the XRD measurement using the Cu tube was performed and the X-ray diffraction profile was drawn. The RINT2000 made by RIGAKU was used as the measurement device. In addition, the tube current was 300 mA, the tube voltage was 50 kV, the measurement step width was 0.01°, and the sweep rate was 1°/min. From the X-ray diffraction profile which was drawn by taking the diffraction angle) 2θ(°) as the horizontal axis and the detected intensity as the vertical axis, it was confirmed whether at least one peak of the detected intensity was present in each of the ranges of 34.38°<2θ(°)<34.64°, 38.70°<2θ(°)<41.20° and 41.60°<2θ(°)<42.80°. Then, α/β and γ/β were calculated. Furthermore, it was confirmed whether the diffraction angle 2θ of the peak derived from the $Nd_5Fe_{17}$ type crystal structure was in the range of 34.38°<2θ(°)<34.64°. The result is shown in Table 2.

TABLE 2

| | | Composition of rare earth sintered magnet | | | | | | Heat treatment condition | |
|---|---|---|---|---|---|---|---|---|---|
| Sample number | Example/ Comparative example | Sm (at %) | Pr (at %) | Nd (at %) | Fe (at %) | C (at %) | (Pr + Nd)/R (Atomic ratio) | Temperature increase rate ° C./s | Retention time h |
| Sample 30 | Example | 18.7 | 5.3 | 0.0 | 76.0 | 0.0 | 0.22 | 5 | 48 |

| Sample number | α/β Peak intensity ratio | γ/β Peak intensity ratio | Angle(2θ) of highest peak derived from Nd5Fe17 type crystal structure (°) | $H_c$ (kOe) | $\sigma_r$ (emu/g) |
|---|---|---|---|---|---|
| Sample 30 | 0.49 | 0.50 | 34.53 | 40.5 | 81.1 |

According to Table 2, in the rare earth sintered magnet, which was obtained by pulverizing, molding and sintering the alloy ingot after the alloy ingot was heated and crystallized, $\alpha/\beta$ and $\gamma/\beta$ were also in a prescribed range, and good magnetic properties were obtained as long as the diffraction angle $2\theta$ in the peak of the detected intensity derived from the $Nd_5Fe_r$ type crystal structure was in the range of $34.38°<2\theta(°)<34.64°$.

What is claimed is:

1. A rare earth permanent magnet comprising R and T, wherein R is two or more rare earth elements and includes Sm and at least one of Pr and Nd, and T is Fe only or Fe and Co;

a content ratio of R with respect to the entire rare earth permanent magnet is 20.0 at % or more and 37.1 at % or less, and a content ratio of T is 47.9 at % or more and 80.0 at % or less;

a content ratio of Sm with respect to the entire R is 50.0 at % or more and 99.0 at % or less, and a total content ratio of Pr and Nd is 1.0 at % or more and 50.0 at % or less;

the rare earth permanent magnet comprises a main phase consisting of crystal grains having an $Nd_5Fe_{17}$ type crystal structure;

at least one peak of a detected intensity are respectively present in each of ranges of $34.38°<2\theta(°)<34.64°$, $38.70°<2\theta(°)<41.20°$ and $41.60°<2\theta(°)<42.80°$ in an X-ray diffraction profile, which is drawn by using a Cu tube to perform an XRD measurement for the rare earth permanent magnet and taking a diffraction angle $2\theta(°)$ as a horizontal axis and the detected intensity as a vertical axis;

$0.38<\alpha/\beta<0.70$ and $0.45<\gamma/\beta<0.70$ are established in which the detected intensity of the peak with the highest detected intensity in the range of $41.60°<2\theta(°)<42.80°$ is set as $\alpha$, the detected intensity of the peak with the highest detected intensity in the range of $34.38°<2\theta(°)<34.64°$ is set as $\beta$, and the detected intensity of the peak with the highest detected intensity in the range of $38.70°<2\theta(°)<41.20°$ is set as $\gamma$; and the peak with the highest detected intensity in the range of $34.38°<2\theta(°)<34.64°$ is a peak derived from the $Nd_5Fe_{17}$ type crystal structure.

2. The rare earth permanent magnet according to claim 1, wherein the content ratio of R with respect to the entire rare earth permanent magnet is 20.3 at % or more and 37.0 at % or less.

3. The rare earth permanent magnet according to claim 1, wherein the content ratio of R with respect to the entire rare earth permanent magnet is 22.2 at % or more and 24.4 at % or less.

4. The rare earth permanent magnet according to claim 1, wherein the total content ratio of Pr and Nd with respect to the entire R is 10.0 at % or more and 35.0 at % or less.

5. The rare earth permanent magnet according to claim 1, wherein the content ratio of T with respect to the entire rare earth permanent magnet is 63.0 at % or more and 79.7 at % or less.

6. The rare earth permanent magnet according to claim 1, further comprising C, wherein a content ratio of C is more than 0 at % and 15.0 at % or less.

7. The rare earth permanent magnet according to claim 6, wherein the content ratio of C is 0.1 at % or more and 4.9 at % or less.

8. The rare earth permanent magnet according to claim 1 which is a rare earth sintered magnet.

9. The rare earth permanent magnet according to claim 1 which has residual magnetization $\sigma_r$ of 40.1 emu/g or more and a coercivity $H_c$ of 32.0 kOe or more.

10. A rare earth permanent magnet comprising R and T, wherein R is two or more rare earth elements and includes Sm and at least one of Pr and Nd, and T is Fe only or Fe and Co;

a content ratio of R with respect to the entire rare earth permanent magnet is 20.0 at % or more and 37.0 at % or less, and a content ratio of T is 63.0 at % or more and 79.7 at % or less;

a content ratio of Sm with respect to the entire R is 51.0 at % or more and 98.0 at % or less, and a total content ratio of Pr and Nd is 2.0 at % or more and 49.0 at % or less;

the total content ratio of Pr and Nd with respect to the entire R is 10.0 at % or more and 35.0 at % or less;

the rare earth permanent magnet comprises a main phase consisting of crystal grains having an $Nd_5Fe_{17}$ type crystal structure;

at least one peak of a detected intensity are respectively present in each of ranges of $34.38°<2\theta(°)<34.64°$, $38.70°<2\theta(°)<41.20°$ and $41.60°<2\theta(°)<42.80°$ in an X-ray diffraction profile, which is drawn by using a Cu tube to perform an XRD measurement for the rare earth permanent magnet and taking a diffraction angle $2\theta(°)$ as a horizontal axis and the detected intensity as a vertical axis;

$0.39<\alpha/\beta<0.69$ and $0.46<\gamma/\beta<0.69$ are established in which the detected intensity of the peak with the highest detected intensity in the range of $41.60°<2\theta(°)<42.80°$ is set as $\alpha$, the detected intensity of the peak with the highest detected intensity in the range of $34.38°<2\theta(°)<34.64°$ is set as $\beta$, and the detected intensity of the peak with the highest detected intensity in the range of $38.70°<2\theta(°)<41.20°$ is set as $\gamma$; and the peak with the highest detected intensity in the range of $34.38°<2\theta(°)<34.64°$ is a peak derived from the $Nd_5Fe_{17}$ type crystal structure.

* * * * *